US009248926B2

(12) United States Patent
Davidson et al.

(10) Patent No.: US 9,248,926 B2
(45) Date of Patent: Feb. 2, 2016

(54) PRODUCE TRAY FILLER

(75) Inventors: Erick A. Davidson, Salinas, CA (US); Rudi C. Groppe, Gilroy, CA (US)

(73) Assignee: HEINZEN MANUFACTURING, INC., Gilroy, CA (US)

( * ) Notice: Subject to any disclaimer, the term of this patent is extended or adjusted under 35 U.S.C. 154(b) by 942 days.

(21) Appl. No.: 13/209,148

(22) Filed: Aug. 12, 2011

(65) Prior Publication Data

US 2012/0037271 A1 Feb. 16, 2012

Related U.S. Application Data

(60) Provisional application No. 61/373,219, filed on Aug. 12, 2010.

(51) Int. Cl.

| | |
|---|---|
| ***B65B 1/06*** | (2006.01) |
| ***B65B 1/24*** | (2006.01) |
| ***B65B 7/16*** | (2006.01) |
| ***B65B 25/04*** | (2006.01) |
| ***B65B 39/00*** | (2006.01) |
| ***B65B 39/14*** | (2006.01) |
| ***B65B 43/44*** | (2006.01) |
| ***B65B 43/52*** | (2006.01) |
| ***B65B 59/04*** | (2006.01) |
| *B65B 1/32* | (2006.01) |

(52) U.S. Cl.

CPC ... *B65B 1/06* (2013.01); *B65B 1/24* (2013.01); *B65B 7/16* (2013.01); *B65B 25/04* (2013.01); *B65B 39/007* (2013.01); *B65B 39/14* (2013.01); *B65B 43/44* (2013.01); *B65B 43/52* (2013.01); *B65B 59/04* (2013.01); *B65B 1/32* (2013.01)

(58) Field of Classification Search

CPC ..... B65B 43/42

USPC ..... 141/73, 79, 129, 134, 146, 152, 163, 141/168; 53/111 R, 428, 436, 438, 523, 527

See application file for complete search history.

(56) References Cited

U.S. PATENT DOCUMENTS

| | | | | |
|---|---|---|---|---|
| 1,413,868 | A * | 4/1922 | O'Bryan et al. | 131/327 |
| 3,267,972 | A * | 8/1966 | Thompson | 141/12 |
| 3,357,155 | A * | 12/1967 | Carruthers | 53/506 |
| 3,476,037 | A * | 11/1969 | Gorby | 100/223 |
| 3,490,391 | A * | 1/1970 | Vogt | 425/89 |
| 4,098,055 | A * | 7/1978 | Calvert | 53/534 |
| 4,224,780 | A * | 9/1980 | Rewitzer | 53/436 |
| 6,715,518 | B2 * | 4/2004 | Finkowski et al. | 141/129 |
| 2003/0213676 | A1 * | 11/2003 | Vorsteher et al. | 198/735.1 |
| 2007/0062159 | A1 * | 3/2007 | Medina et al. | 53/399 |
| 2009/0165425 | A1 * | 7/2009 | Medina et al. | 53/391 |
| 2012/0037271 | A1 * | 2/2012 | Davidson et al. | 141/129 |
| 2014/0048170 | A1 * | 2/2014 | Evans et al. | 141/12 |

* cited by examiner

*Primary Examiner* — Jason K Niesz
*Assistant Examiner* — Andrew Schmid
(74) *Attorney, Agent, or Firm* — GSS Law Group

(57) ABSTRACT

An apparatus for filling a produce tray with agricultural produce includes a tray loading station with a fill hopper for receiving the agricultural produce, a produce compression station including at least one tuck finger platen, and a conveyer including a plurality of tray carriers for moving the produce tray from the tray loading station to the produce compression station. Some embodiments of the invention also include a split chute for transferring the agricultural produce from the fill hopper to the produce tray and a trolley for selectively positioning the split chute under the fill hopper or tuck finger platen. Another embodiment of the invention includes a tuck finger platen for compressing agricultural produce near the center of the tray less than agricultural produce near the interior walls of the produce tray. Yet another embodiment of the invention includes steps in a method for loading agricultural produce into a produce tray.

15 Claims, 12 Drawing Sheets

PRODUCE TRAY FILLER

CROSS REFERENCE TO RELATED APPLICATIONS

This application claims the benefit of U.S. Provisional Application No. 61/373,219 filed Aug. 12, 2010, incorporated herein by reference in its entirety.

FIELD OF THE INVENTION

Embodiments of the invention are generally related to equipment for filling containers with agricultural produce.

BACKGROUND

A produce tray is a container for agricultural produce such as fruit and vegetables. Many different sizes and shapes of produce trays are available. Produce trays, also referred to as a produce tills, protect their contents during shipping and handling by preventing contact between the produce within and foreign contaminants, sealing the contents to maintain freshness, and limiting crushing and bruising damage to the produce. Damaged or contaminated produce may have reduced economic value, impaired flavor, poor visual appeal, or present health risks to consumers. A produce tray may be sealed with a polymer film attached to the top of the tray by heat welding, ultrasonic welding, or by a sealing band. Some produce trays use a snap-on cover. Other produce trays have a clamshell cover formed as part of the tray.

A bulk supply of agricultural produce may be subdivided into smaller portions and loaded into produce trays in a continuous process. Produce trays to be filled may be placed on the input end of a conveyer comprising one or more continuous belts, chains, or moving frames. The conveyor may have shaped apertures, pockets, cleats, pins, etc. to hold produce trays securely and with a predetermined tray-to-tray spacing. The conveyer moves produce trays to sequential processing stations, for example hoppers for transferring produce to individual produce trays, equipment for closing loaded produce trays, weighing equipment, and so on. Filled and sealed produce trays are removed from the output end of the conveyor. Conveyers known in the art are configured to hold a selected size and shape of produce trays and may need substantial modification to hold trays having a different size and shape.

Produce trays may be filled with a weighed portion of agricultural produce. A large amount of air may be trapped between pieces of produce in a weighed portion. For example, about half of the volume of a mound formed by dumping a portion of leafy vegetables such as spinach or lettuce into a produce tray may be air trapped in spaces between leaves. Because of the trapped air or because pieces of produce may be dumped into a disorganized mound in the tray, the top of the mound may extend above the top of the tray. Before sealing a produce tray it may therefore be necessary to compress the produce in the tray until the top of the mound is below the top of the tray.

A plunger may be used to compress the mound of produce in a tray or workers may apply hand pressure to compress the mound. A plunger may have a relatively flat compression face, i.e., the side of the plunger that contacts produce in a tray. Produce may adhere to a flat compression face when the plunger is removed from a tray, possibly resulting in underweight portions being sealed into produce trays, unwanted transfer of produce from one tray to another, or produce dropped on the floor. Produce may be blown out of a tray by air expelled during compression with a flat plunger. Produce trapped between an outer edge of a plunger and an interior side wall of a produce tray may be crushed or torn. Produce expelled from the tray during compression may fall on an upper surface of the produce tray and may interfere with sealing of the tray. Or, spilled produce may accumulate on the floor or on handling equipment and must be cleaned up to prevent safety and sanitation problems.

A mound of produce dumped in a tray is usually higher toward the center of the tray than near the tray edges. A flat plunger may over-compress the raised center of the mound and cause bruising or crushing of some of the produce in the tray. Some plungers have stepped compression faces to reduce adhesion by surface tension and suction between the plunger's compression face and pieces of produce. Plungers with stepped compression faces may have improved performance compared to plungers with flat compression faces, but problems associated with produce adhesion, over-compression, and expulsion of produce by spillage and airflow during produce compression remain. More than one compression operation may be needed before tray sealing since produce compressed with either a flat or stepped plunger may re-expand to a substantial fraction of its original volume after each compression step. For example, some agricultural produce approximately doubles in volume after being compressed by a flat or stepped plunger. It may therefore be necessary to install more than one compression station along a conveyor, resulting in increased amounts of damaged produce and higher equipment cost, facility cost, and operating cost. It may also be necessary to have workers monitor produce trays after each compression step and manually finish each tray. Each additional person needed for tray processing not only raises labor costs but introduces additional risk of human injury from working in close proximity to moving machinery and risk of biological contaminants being transferred from workers to food in produce trays.

SUMMARY

An apparatus for filling a produce tray with agricultural produce includes a tray loading station with a fill hopper for receiving the agricultural produce, a produce compression station including at least one tuck finger platen, and a conveyer including a plurality of tray carriers for moving the produce tray from the tray loading station to the produce compression station. Embodiments of the invention also include a split chute for transferring the agricultural produce from the fill hopper to the produce tray and a trolley for selectively positioning the split chute under the fill hopper or tuck finger platen.

Another embodiment of the invention includes a tuck finger platen for compressing agricultural produce near the center of the tray less than agricultural produce near the interior walls of the produce tray.

Another embodiment of the invention includes steps in a method for loading agricultural produce into a produce tray. The disclosed method includes loading the agricultural produce into the produce tray though a split chute having two separable segments connected together, moving the produce tray and split chute together from a tray loading station to a tray compression station, and lowering a tuck-finger platen into the produce tray, thereby compressing the agricultural produce until the agricultural produce is entirely contained within the sealable volume of the produce tray. Steps in the method further include separating the two segments of the split chute from one another, returning the two segments of the split chute to the tray loading station; and closing the produce tray.

This section summarizes some features of the present invention. These and other features, aspects, and advantages of the embodiments of the invention will become better understood with regard to the following description and upon reference to the following drawings, wherein:

DESCRIPTION

Figure 1:
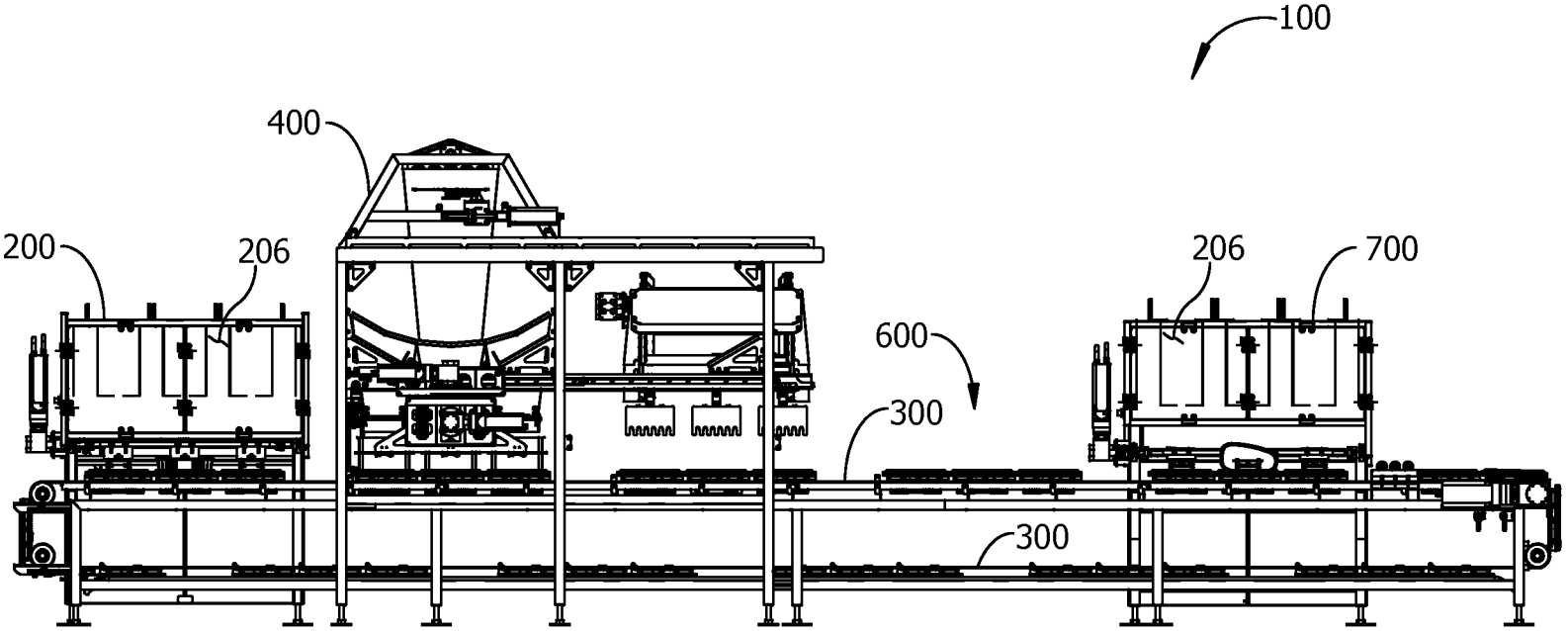
FIG. 1 shows an orthographic view toward the right side of an example of a produce tray filler embodiment of the invention.

An embodiment of the invention comprising a produce tray filler automatically fills produce trays with measured quantities of agricultural produce, compresses the produce to fit entirely within the enclosable volume of a produce tray, and closes the tray to protect its contents. Embodiments of a produce tray filler include a conveyor for moving produce trays from one processing station to the next within the produce tray filler. The conveyor includes a quick-change tray carrier system with removable, interchangeable inserts for holding produce trays securely and in accurate positions relative to the conveyor and processing stations in the produce tray filler. Different insert embodiments are provided, each insert embodiment having a central aperture shaped to hold a different size or shape of produce tray. The conveyor moves a batch of one or more produce trays into position at a processing station, holds the trays stationary while the processing station performs a process step such as loading produce trays with produce, compressing produce in the trays, or closing the trays, then advances the batch of produce trays to the next processing station.

Embodiments of the invention include at least one movable plunger assembly for compressing produce in a produce tray before the tray is closed. The process of compressing produce in a produce tray before the tray is sealed is sometimes referred to as "tamping". The plunger assembly includes a platen shaft attached to a top side of a platen. A bottom side of the platen, also referred to as the compression side of the platen, is formed with a plurality of rounded protrusions referred to herein as "tuck fingers" for their resemblance to splayed fingers on a human hand. Platens in accord with an embodiment of the invention are referred to as "tuck-finger platens" because embodiments of the invention mimic the actions of the most skilled human workers, who manually tuck produce more tightly around the interior sides of a tray than in the middle of the tray to reduce crushing and bruising of the produce and to prevent the produce from re-expanding after it is compressed. For these reasons, the tuck fingers are arranged around the periphery of the compression face so as to leave an arched void in the center of the compression side of the platen.

Pairs of tuck fingers on opposite sides of the platen are joined by rounded, arcuate ridges. Because of the protruding tuck fingers and arcuate ridges separated by rounded channels, produce seldom adheres to the compression face of the platen. The protruding tuck fingers and arcuate ridges cause a mound of produce dumped into a produce tray to be compressed more near the interior sides of a produce tray than near the center of the tray, thereby reducing bruising and crushing of produce compared to flat or stepped platens. Agricultural produce may be considered to be near the interior sides of a produce tray when the produce is in contact with the interior sides or is separated from the interior sides by less than about twice the diameter of the rounded end of the platen's tuck fingers. Produce that is not near the interior sides of the produce tray may be considered to be near the center of the enclosable volume of the tray. The enclosable volume of a produce tray is the void formed between the interior side walls, the interior bottom of the tray, and the lid or cover of the tray when the tray has been closed.

Spaces or channels between the tuck fingers and arcuate ridges provide an escape path for air venting out of a mound of produce being compressed in a tray, with the result that less produce is forced out of the tray than by processes known in the art using flat or stepped platens. Embodiments of the invention are particularly well suited for packing and sealing leafy, easily damaged vegetables such as spinach or lettuce into produce trays. The "tucking" action of the platen fingers along the tray walls, that is, compressing produce more tightly around the interior periphery of the tray's enclosable volume than at the center, reduces the tendency of produce to rebound in volume after being compressed by the platen. Fewer compression steps are needed to load and seal a produce tray using embodiments of the invention, compared to flat or stepped platens known in the art. Fewer human workers are needed for inspection of loaded trays, thereby reducing operating costs, reducing safety risks associated with persons working in close proximity to moving machinery, and reducing health risks associated with human handling of food items.

A produce tray filler embodiment of the invention includes at least one split transfer chute for directing produce from a hopper into a produce tray. Each segment of a split transfer chute is carried on a separate trolley assembly. The trolley assemblies synchronously shuttle back and forth between a produce loading station and a produce compression station. Actuators on each trolley force the two segments of the split transfer chute together and lower the chute until the chute's lower edges are within a produce tray to be filled, preventing spillage during loading of produce. The split transfer chute and produce trays travel together to a compression station, where the platen is lowered through the split transfer chute and compresses the produce in the tray. The split transfer chute optionally remains in place during produce compression, eliminating ejection of produce from the tray and keeping the top rim of the tray clear of displaced produce. The left and right segments of the split transfer chute may optionally be separated and returned to the produce loading station while the platen is still extended below the top edges of the split transfer chute. The split transfer chute enables a next batch of trays to be filled with produce while the previous batch of filled trays is still undergoing compression. The split transfer chute therefore improves production throughput, for example through expressed as a number of filled and sealed produce trays completed per selected time interval, compared to tray filling machines known in the art.

The split transfer chute also enables a reduction in an overall height of an embodiment of the invention compared to a machine using conventional unitary (i.e., segments not separable) transfer chutes, because the platen need not retract above the top edges of transfer chute for the chute or produce tray to be moved. Reducing the overall height of a produce tray filler offers several advantages. For example, an embodiment of the invention may be put in a space with a lower ceiling than tray fillers currently available may need, thereby reducing facility cost. Maintenance personnel are able to reach the top parts of a tray filler embodiment of the invention more easily, making it easier to perform repairs and keep equipment clean without climbing ladders. Stroke lengths of actuators such as hydraulic cylinders, electric solenoids, linear motors, or air cylinders used to raise and lower platens, transfer chutes, and other parts can be shorter, reducing capital equipment costs, maintenance costs, and energy consumption during equipment operation.

Referring now to the figures, an example of a produce tray filler in accord with an embodiment of the invention is shown in FIG. 1. As may be seen in FIG. 1, an embodiment of the invention 100 optionally includes a conveyer 300 for carrying produce trays from one processing station to another. The conveyer 300 travels in a closed loop, with the upper portion of the loop advancing from the input end of the produce tray filler 100 at the left side of the illustration to the output end of the produce tray filler 100 at the right side of the illustration, and the lower portion of the loop moving in the opposite direction. In some embodiments of the invention, the conveyor 300 is implemented as a pair of synchronously driven flexible belts. The conveyor 300 may alternatively be implemented as a single wide flexible belt, as a pair of synchronously driven chains, or as a series of sequentially-connected, hinged frames.

A first optional processing station is shown near the input end of the produce tray filler 100 of FIG. 1, the input end being at the left side of the figure. In the illustrated example, the first optional processing station is a tray de-nester 200, an apparatus for removing individual trays from one or more bins containing nested stacks of trays, then putting the trays into tray carriers on the conveyor 300. Apparatus for de-nesting trays will be familiar to a person of ordinary skill in the art and will not be described further herein.

A tray loading station 400 is adjacent to the tray de-nester 200. As will be described later in more detail, the tray loading station 400 includes a produce loading station for transferring produce from a hopper to produce trays and a produce compression station for compressing produce in the filled produce trays. The produce tray filler 100 example of FIG. 1 processes produce trays in batches of three. The produce compression station in the tray loading station 400 therefore includes three platens and three split transfer chutes. The split transfer chutes are attached to trolleys which shuttle between the produce loading station and the produce compression station. Alternative embodiments of a produce tray filler may be arranged to process batches comprising either fewer than three or more than three trays.

A second optional processing station is located near the output end of the produce tray filler 100 of FIG. 1, at the right side of the figure. In the illustrated example, the second optional processing station is a tray closing station 700. The tray closing station 700 closes and seals filled and compressed produce trays, either by welding a polymer film over the top of the tray ultrasonically or with heat, by attaching a separate snap-on lid, or by closing a clamshell lid formed as an integral part of the produce tray. Produce trays having snap-on or clamshell lids may optionally be sealed, for example to prevent tampering or pilferage, by welding the tray top to the tray. Apparatus for closing and sealing trays will be familiar to a person of ordinary skill in the art and will not be described further herein.

As may be seen in FIG. 1, a gap separates the output end of the tray loading station 400 from the input end of the tray closing station 700. The gap represents a third optional processing station, a visual inspection station 600. The visual inspection station 600 provides a place for a human inspector to examine filled and compacted produce trays on the conveyor 300 and observe operation of the tray loading station 400 and tray closing station 700. Even though a visual inspection may be provided, embodiments of the invention do not require tray cleanup (sometimes referred to as "finishing") by human workers to prepare the trays for sealing, unlike previously known tray filling equipment or manual tray filling procedures.

Some of the moving parts in embodiments of a produce tray filler 100 are relatively large and move very quickly and therefore pose a safety risk to any person in close proximity to the machinery. Safety covers may optionally be provided to reduce the risk of human contact with moving parts. The tray de-nesting station 200 and tray closing station 700 in FIG. 1 are shown with safety covers 206 in place. The tray loading station 400 in FIG. 1 and is shown without safety covers for purposes of illustration. In normal operation, the tray loading station 400 would also be equipped with safety covers.

Figure 2:
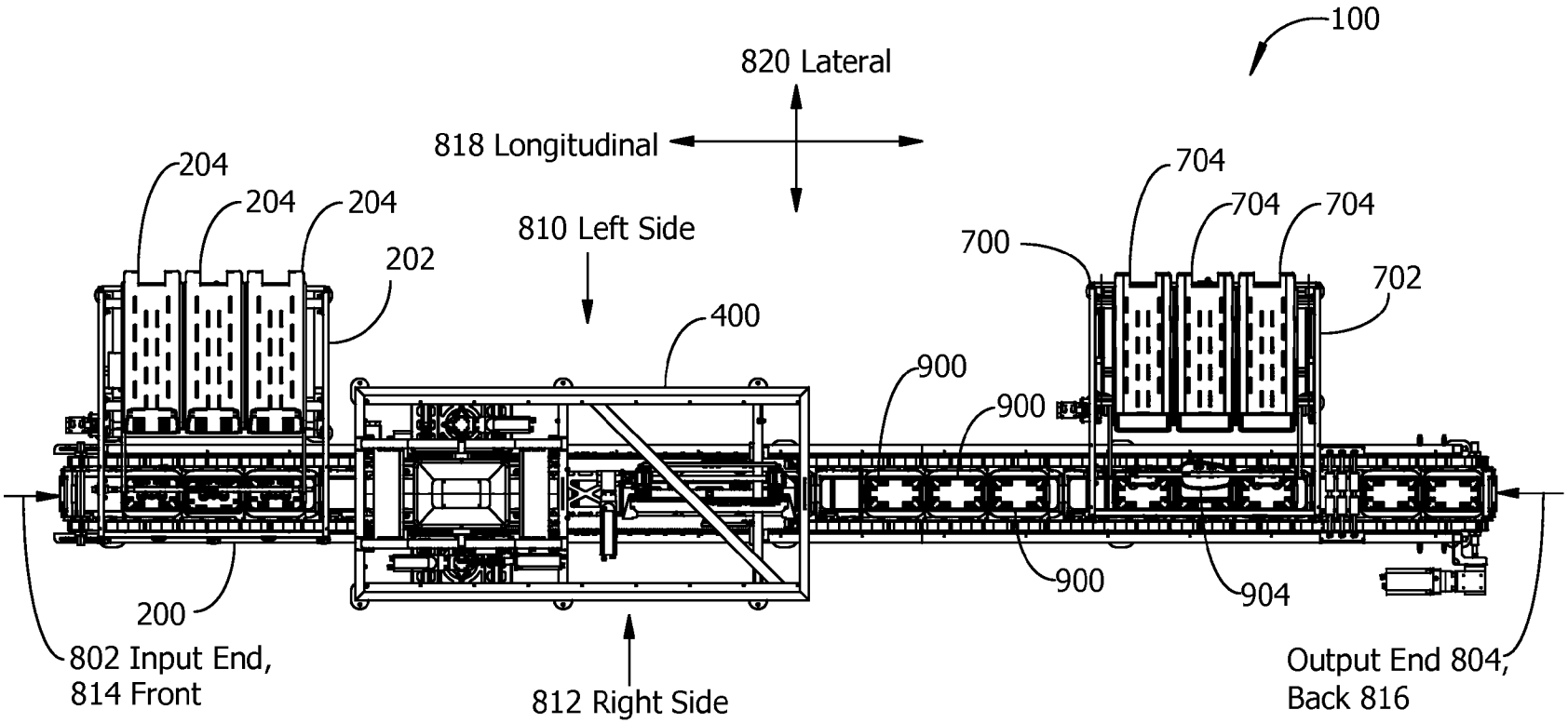
FIG. 2 shows an orthographic view toward the top side of the produce tray filler of FIG. 1.

FIG. 2 shows an orthogonal view toward the top of the produce tray filler 100 of FIG. 1. FIG. 2 also shows examples of direction references used to described the embodiments of the invention. A horizontal reference arrow at the left side of the figure denotes the input end 802 of the produce tray filler 100 and further indicates a viewing direction toward the front side of the produce tray filler 100. Other reference arrows denote the left side 810, the right side 812, the output end 804, and the back side 816 of the produce tray filler 100. Another pair of double ended reference arrows indicates longitudinal directions 818 and lateral directions 820. These directional references also apply to descriptions of components making up embodiments of the produce tray filler 100. For example, in FIG. 2, three tray racks 204 attached to a frame assembly 202 for the tray de-nester 200 are shown at the input end 802 and extending laterally from the left side 810 of the produce tray filler 100. Three lid racks 704 attached to a frame assembly 702 for the tray closing station 700 are shown at the output end 804 and extending laterally from the left side 810 of the produce tray filler 100. FIG. 2 also shows several examples of a produce tray 900 and an example of a produce tray cover 904 partially attached to the produce tray underneath the cover. The produce trays 900 and produce tray cover 904 are examples of produce trays which may be processed by an embodiment of the invention 100.

Figure 3:
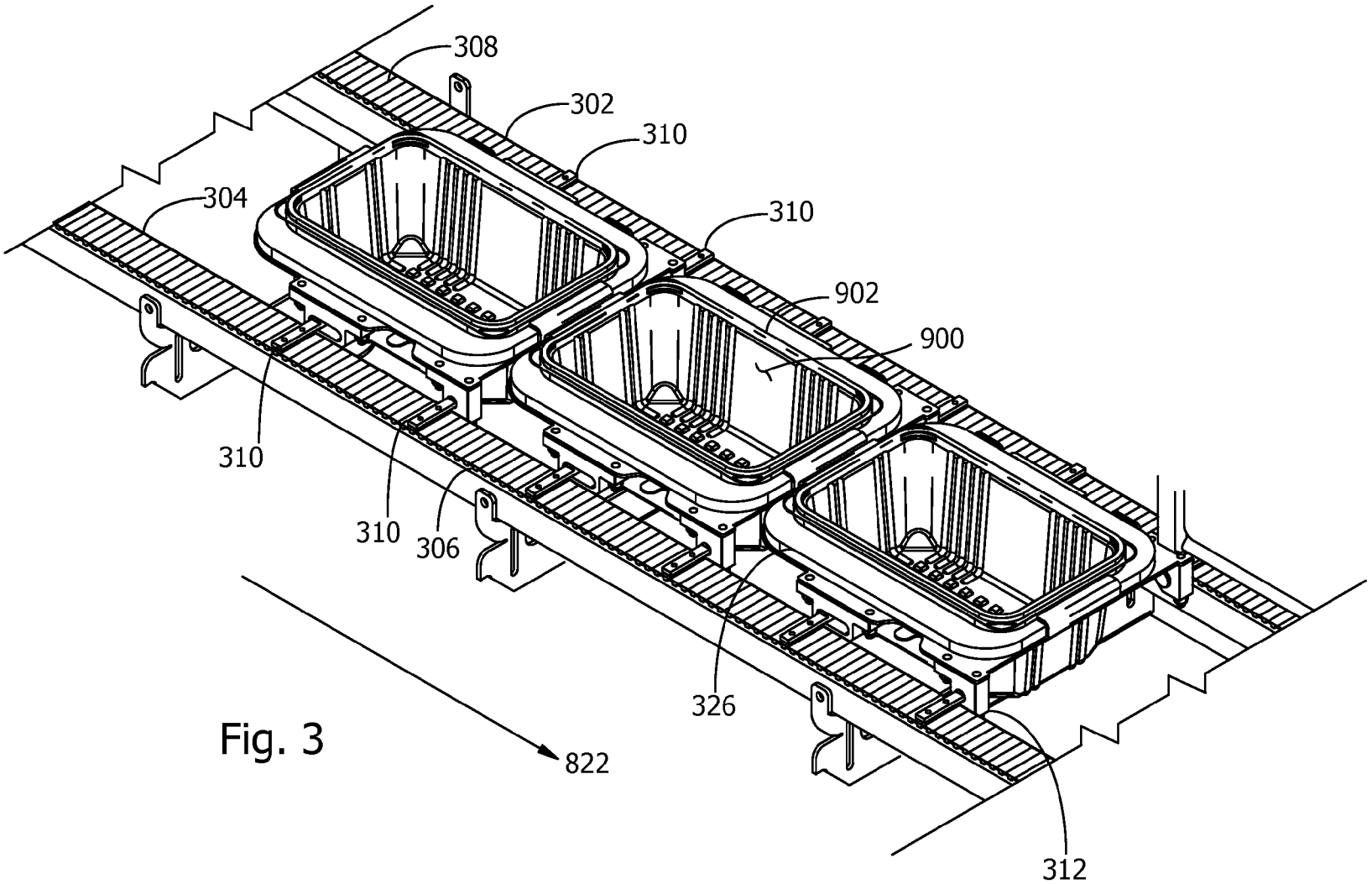
FIG. 3 shows a partial pictorial view of produce trays, tray carriers, and conveyer belts from the example of FIG. 1.

Produce trays are moved from one processing station to the next by the conveyor. FIG. 3 shows an example of three produce trays in one processing batch on a conveyer comprising a left belt 302 and a right belt 304. The left belt 302 and right belt 304 advance synchronously with the produce trays from the input end of the conveyor to the output end of the conveyor as indicated by a conveyer direction of advance arrow 822. Each produce tray 900 rests in a tray insert 326 having a central aperture shaped to fit a selected style of produce tray. The tray inserts 326 in FIG. 3 have a central aperture shaped for a rectangular produce tray. Each tray insert 326 removably but securely engages with a tray carrier 312. Each tray carrier 312 rotatably connects to carrier support bars 310 attached to the top surface 308 of the right belt 304 and left belt 302. In the example of FIG. 3, each tray carrier 312 is connected to four carrier support bars 310. In alternative embodiments of a produce tray filler, a different number and arrangement of support bars may be used to couple tray carriers to a conveyor.

The left belt 302 and right belt 304 move synchronously with one another through the produce tray filler 100. The belts are driven by gears on a common motor-driven shaft (shaft, gears, and motor not illustrated) which engage with indexing teeth 306 on the bottom side of the belts. The arrangement of carrier support bars 310 and tray carriers 312 permit the tray carriers and tray inserts to round the turns at the input end and output end of the conveyor. The left and right belts (302, 304) move the produce trays 900 to each processing station in the produce tray filler 100, stop moving to hold the trays stationary while each processing step is completed, then advance the trays to the next processing station.

Each of the examples of a produce tray 900 shown in FIG. 3 have a rectangular perimeter shape and have a top surface or rim 902 against which a seal is formed when the tray is closed. Trays may be closed by attaching a snap lid to the rim 902, by closing a clamshell lid formed integrally with the produce tray, or by ultrasonically or heat welding a polymer film to the rim 902. Embodiments of the invention automatically keep the top surface 902 clear of produce so that the tray may be fully closed and sealed. In contrast to embodiments of the invention, produce ejected onto the top surface 902 by tray filling equipment having plungers with flat or stepped compression faces requires that trays be manually finished by human workers before the trays can be sealed, otherwise proper sealing may not occur. Embodiments of the invention do not require manual finishing of produce trays, thereby reducing operating costs and improving human safety as previously explained.

Embodiments of a produce tray filler 100 may use a quick-change system for holding produce trays on the conveyor. The quick-change system permits the produce tray filler 100 to be rapidly, efficiently, and economically reconfigured for different sizes and shapes of produce trays by replacing a tray insert having an aperture shaped for one kind of produce tray, for example a rectangular tray, with a tray insert shaped for another kind of produce tray, for example a tapered, square, or round tray. In comparison to embodiments of the invention, conveyer systems known in the art do not use quick-change inserts and may need substantial disassembly, reassembly, and readjustment, or recalibration of filling and tamping equipment along the path of the conveyer, to reconfigure for different sizes and shapes of produce trays.

Figure 4:
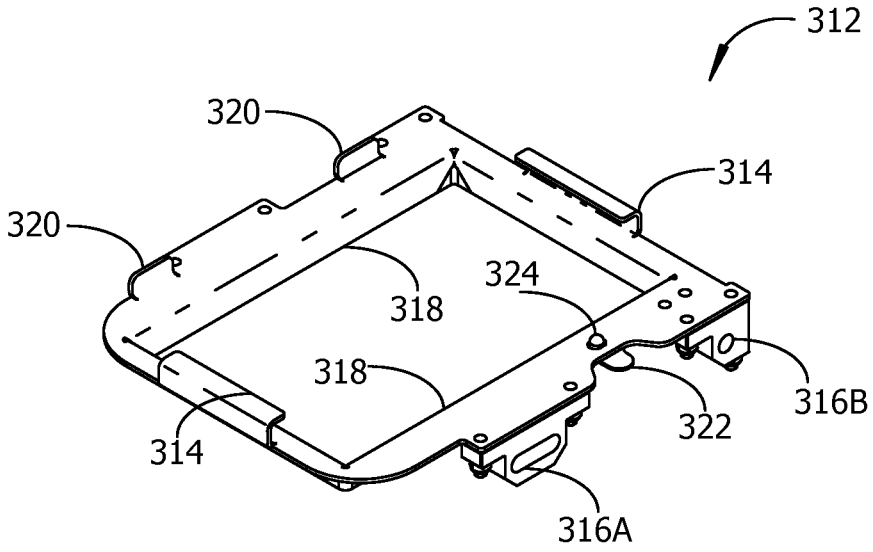
FIG. 4 shows a pictorial view toward the top surface of an example of a tray carrier.

Examples of a tray carrier and tray inserts comprising a quick-change tray system are shown in FIGS. 4-7. In FIG. 4, a pictorial view of an example of a tray carrier 312 has a large central aperture defined by edges 318. The central aperture is large enough to accommodate a wide variety of produce trays. The tray carrier is formed with support bar apertures 316A, 316B along its left and right sides. The support bar apertures slidably engage with support bars on the conveyer as previously described. Two tray insert brackets 314 attach front and back edges of the top surface of the tray carrier 312. Channels formed within the tray insert brackets 314 are sized for a sliding fit of a tray insert. Two insert stops 320 are provided along another edge of the top surface of the tray carrier 312. A tray insert slides into the channels formed by the tray insert brackets 314 until the tray insert contacts the insert stops. In alternative embodiments of a tray carrier, different arrangements of insert tray brackets and insert stops may be used. The insert brackets and insert stops cooperate to accurately position a produce tray held by the tray insert relative to hoppers, chutes, and other equipment in the produce tray filler, thereby reducing produce spillage and damage to trays, tray contents, and parts of the produce tray filler.

Figure 5:
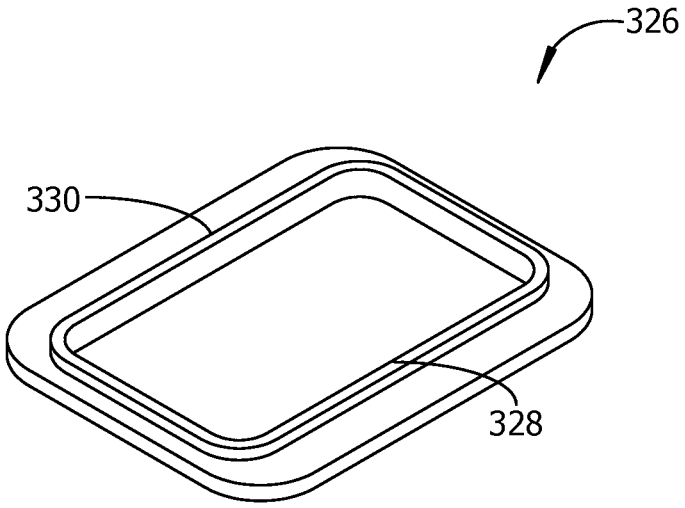
FIG. 5 is a pictorial view of an example of a tray insert for holding a rectangular produce tray with rounded corners, for use with the tray carrier of FIG. 4.
Figure 6:
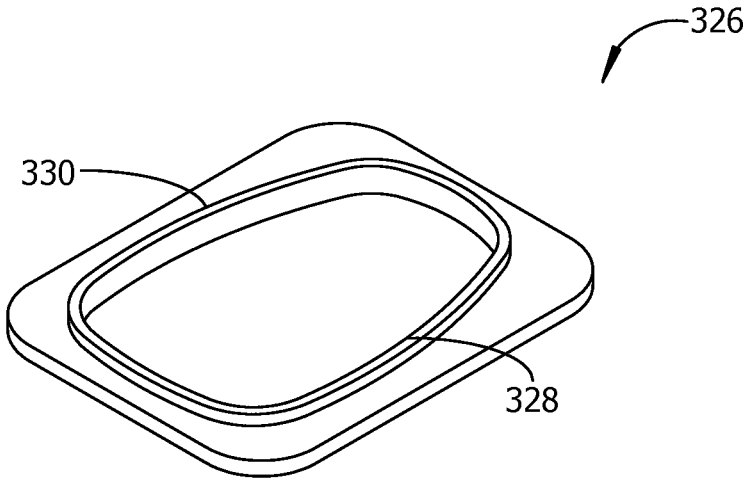
FIG. 6 is a pictorial view of an example of a tray insert for a tapered produce tray, for use with the tray carrier of FIG. 4.
Figure 7:
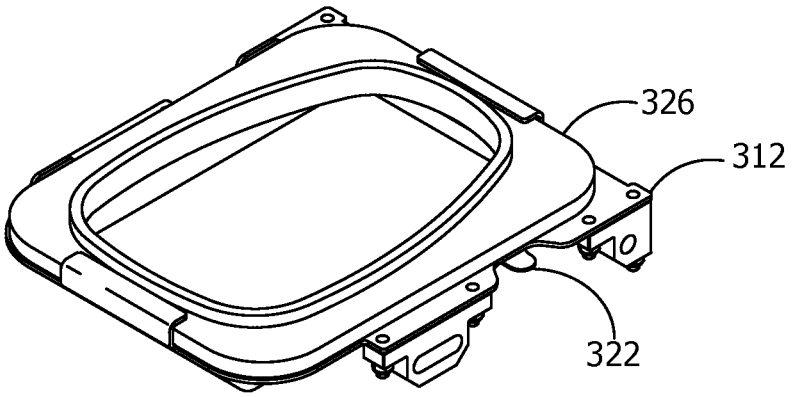
FIG. 7 is a pictorial view from above showing a quick-change produce tray holder comprising the tray insert of FIG. 6 slidably engaged with the tray carrier of FIG. 4.

Examples of tray inserts 326 are shown in pictorial views in FIGS. 5-6. A tray insert 326 has overall length (longitudinal direction) and width (lateral direction) dimensions selected for a sliding fit between the tray insert brackets 314 on the top surface of a tray carrier 312. A tray aperture edge 328 on a top surface 330 of a raised ridge defines a central aperture in the tray insert 326. The central aperture in the tray insert 326 is no larger than the central aperture in the tray carrier 312 and has a perimeter shape and dimensions corresponding to the perimeter shape and dimensions of the type of produce tray the insert is intended to carry. Produce trays are generally formed with a horizontal flange or ridge around the top edge of the enclosable volume of the tray. The horizontal flange or ridge rests on the top surface 330 when the produce tray is placed in the central aperture in the tray insert 326. The perimeter shape of a produce tray is the shape of the tray's perimeter where the horizontal flange or ridge joins the exterior side walls of the tray. In FIG. 5, the tray insert has a central aperture having a rectangular perimeter shape for holding a rectangular produce tray with a perimeter shape that is approximately the same size and shape as the tray's central aperture. FIG. 6 shows an example of a tray insert 326 having a central aperture shaped to hold a tapered produce tray. FIG. 7 shows the tray insert 326 from the example of FIG. 6 removably assembled to a tray carrier 312.

FIGS. 4 and 7 also illustrates an example of a quick-release lever for holding the tray insert 326 in place against the top surface of the tray carrier 312. The quick-release lever 322 may operate by slidably engaging a pin 324 with a corresponding aperture (not shown) on the bottom surface of the tray insert 326, although many alternative variations of quick-release mechanisms which may be used to removably couple a tray insert 326 to a tray carrier 312 will be known to one skilled in the art.

Figure 8:
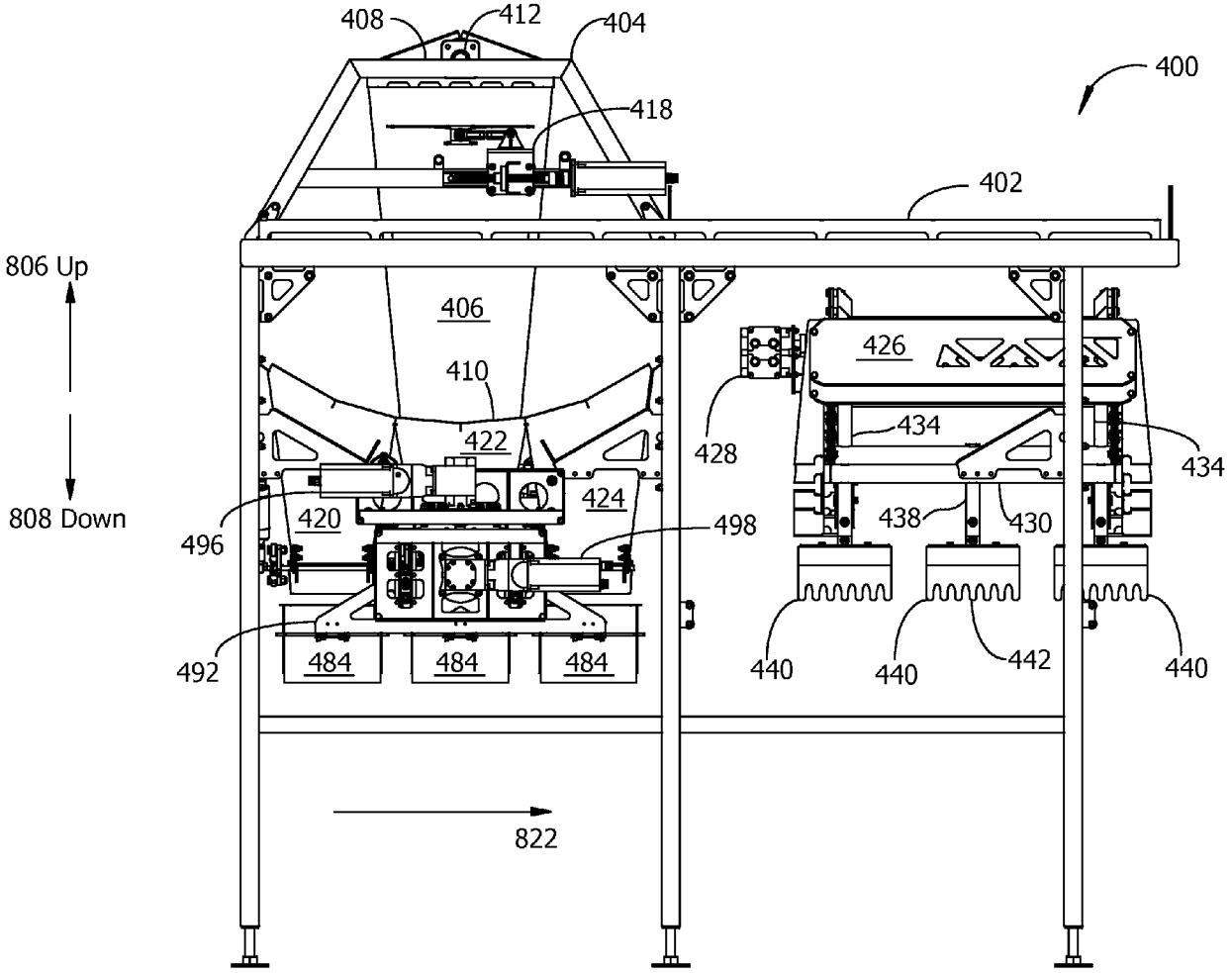
FIG. 8 is a partial orthographic view toward the right side of the tray loading station from the produce tray filler of FIGS. 1-2.

The tray loading station 400 from the example of FIGS. 1-2 is shown in a partial orthogonal view toward the right side in FIG. 8. The tray loading station 400 is organized as a produce loading station 404 comprising a fill hopper 406 and a produce compression station 426 comprising one or more plunger assemblies. The conveyor and some other parts have been omitted from FIG. 8 to simplify the illustration. FIG. 8 shows a reference arrow marked 806 Up to indicate an upward vertical direction, a reference arrow marked 808 Down to indicate a downward vertical direction, and a conveyor direction of advance reference arrow 822 to indicate that the input end of the tray loading station is at the left side of the figure. The tray loading station 400 includes a support frame 402 to which components for the produce loading station 404 and the produce compression station 426 are attached.

Produce to be loaded into produce trays is introduced in measured quantities through the input end 408 of a fill hopper 406. Equipment for measuring a selected quantity of produce, for example weighing equipment, and equipment for introducing the selected quantity of produce into the fill hopper 406, for example a separate conveyer system, will be familiar to one skilled in the art and will not be described herein. The interior surfaces of the fill hopper 406 may be formed with bumps or dimples to prevent produce introduced into the input end 408 from sticking to the sides of the fill hopper 406. The interior surfaces of the fill hopper 406 may optionally be coated with a non-stick material. The output end 410 of the fill hopper 406 may selectively be positioned above one of three stationary chutes (420, 422, 424) by a hopper rotation actuator 418 which swings the fill hopper 406 about a pivot 412. In FIG. 8, the output end 410 of the fill hopper 406 is positioned above the middle stationary chute 422.

In the illustrated example, the front 420, middle 422, and back 424 stationary chutes empty into three split chutes 484. The split chutes 484 are carried on a trolley assembly and are capable of moving back and forth from the produce loading station 404 to the produce compression station 426. When produce is to be introduced into the produce trays, the split chutes 484 are positioned in the produce loading station 404 with the bottom edges of each chute below the top edges of each of the produce trays, directing all produce dropped through the fill hopper 406, stationary chutes (420, 422, 424), and split chutes 484 into the waiting produce trays (not shown in FIG. 8), thereby preventing spillage of produce. The three split chutes 484 in FIG. 8 are attached to a split chute elevation arm 492 for simultaneously raising and lowering the split chutes by means of a split chute elevation actuator 498. The two segments of each split chute 484 may be separated from one another or rejoined together by a split chute separation actuator 496. Operation of the separation and elevation actuators will be explained later in more detail.

Continuing with FIG. 8, the produce compression station 426 includes three plunger assemblies joined to a plunger bar 430. The plunger bar 430 is connected to two plunger bar shafts 434 which are driven in vertical motion by a plunger elevation actuator 428. Each of the three plunger assemblies includes a platen shaft 438 attached to a top side of a tuck finger platen 440. The bottom side or compression side 442 of each tuck finger platen 440 comes into contact with produce in produce trays (not shown) during produce compression. All three tuck finger platens 440 move up and down simultaneously by the action of the plunger bar 430, plunger bar shafts 434, and plunger elevation actuator 428.

Figure 9:
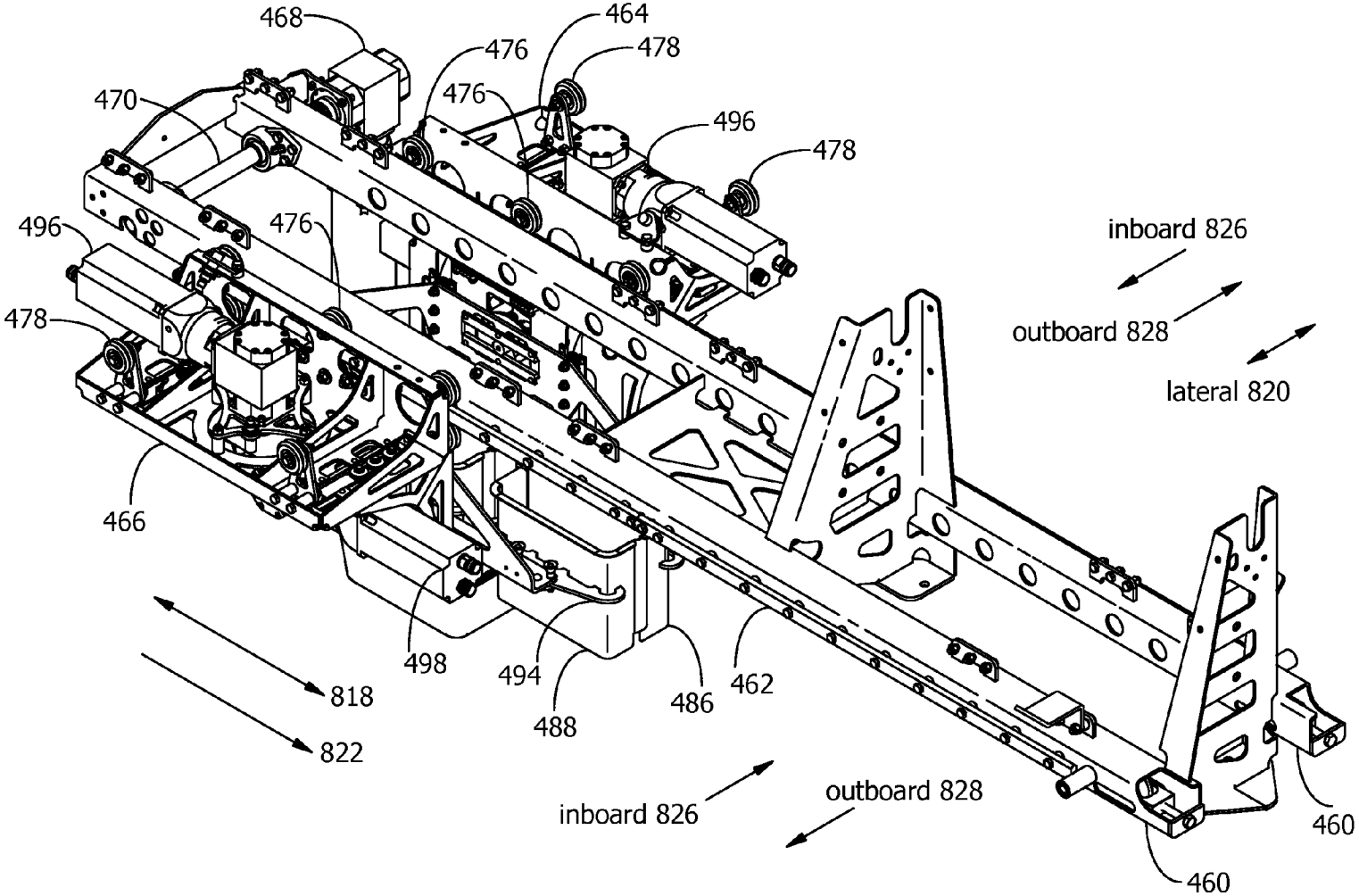
FIG. 9 is a partial pictorial view of a portion of the tray loading station of FIG. 8, showing left and right side trolley assemblies and trolley rails.

The split chutes 484 shuttle back and forth on trolleys between the produce loading station 404 and the produce compression station 426 in the tray loading station 400. A partial pictorial view from above of the trolleys, split chutes, and related actuators is shown in FIG. 9. FIG. 9 also shows reference arrows for directional references. The conveyor's direction of advance is indicated by an arrow 822, with the arrow pointing toward the output end of the tray loading station 400. A double-ended longitudinal reference arrow 818, a double-ended lateral reference arrow 820, two opposing reference arrows indicating inboard 826 directions (i.e., from a side toward a longitudinal midline of the produce tray filler 100), and two opposing arrows indicating outboard directions 828 (i.e., from the longitudinal midline toward a side of the produce tray filler 100) are also marked in FIG. 9.

Each split chute comprises two segments which are separable from one another during some process steps performed by embodiments of the invention. A split chute comprises a right side 488 and a left side 486 as indicated in FIG. 9. The split chute right side 488 is attached to a split chute bracket 494 driven in vertical motion by a split chute elevation actuator 498. All three split chute right sides 488 (only one of which is visible in FIG. 9) are simultaneously raised or lowered by the split chute elevation actuator 498. The split chute right side 488 is separated from the split chute left side 486 by a split chute separation actuator 496, which simultaneously moves all three split chute right sides (only one of which is visible in FIG. 9) attached to the split chute bracket 494.

Figure 11:
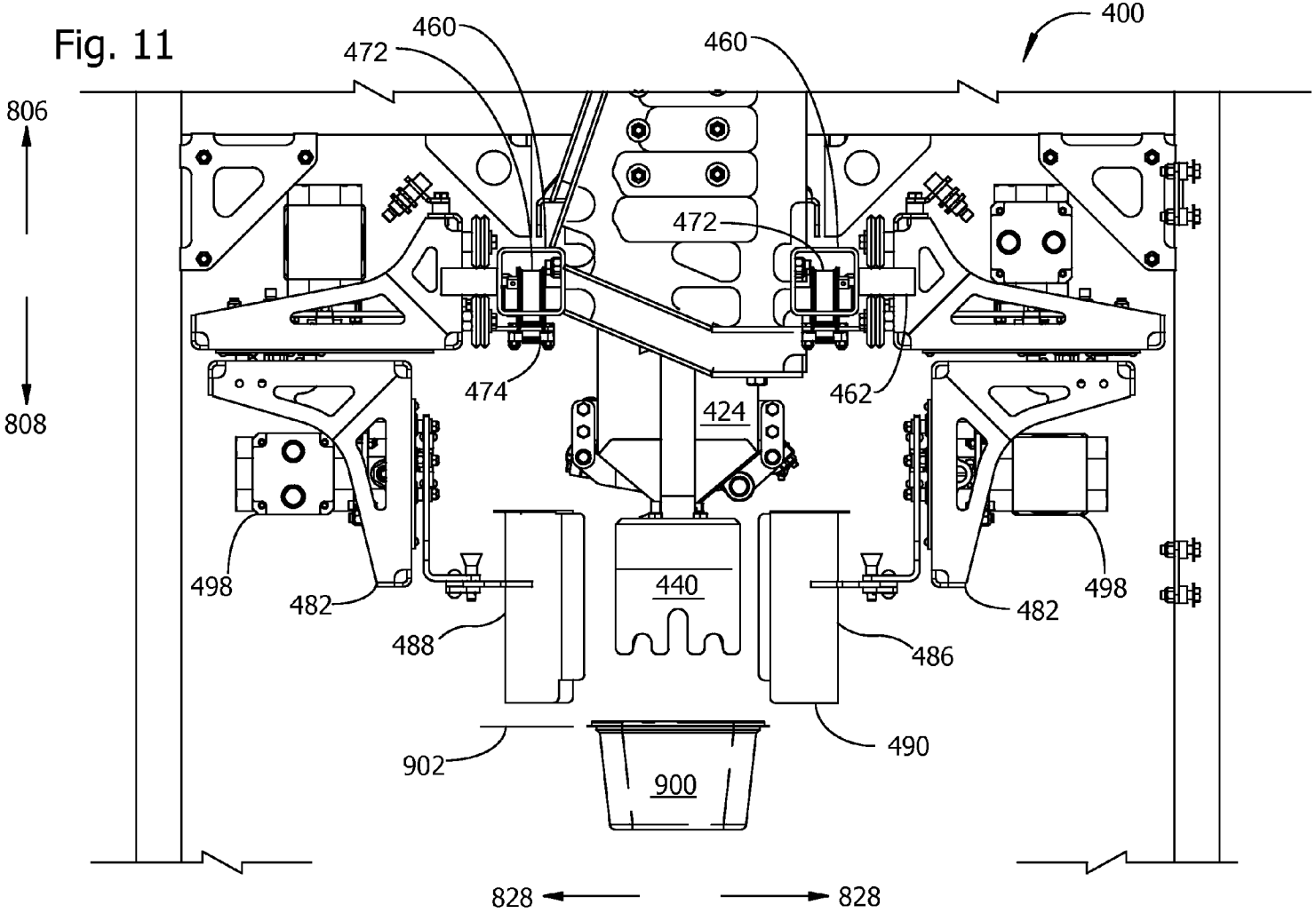
FIG. 11 is a partial expanded view of the tray loading station from FIG. 10, showing left and right sides of the split transfer chute separated from one another while the plunger is extended between the sides of the split transfer chute.

Split chute right sides are coupled to a right side trolley assembly 466 and split chute left sides are coupled to a left side trolley assembly 464. The two trolley assemblies shuttle synchronously back and forth in a longitudinal direction along two trolley rail support beams 460, driven by a motor 468 and a drive shaft 470 coupled to two trolley drive belts, one trolley drive belt partly enclosed within each support beam 460. Two trolley drive belts 472, partially enclosed in trolley rail support beams 460 as shown in FIG. 11, are coupled to the trolley assemblies by a drive belt clamp 474 coupling each trolley to its adjacent trolley drive belt. The trolley drive belts 472 are able to reverse their direction of motion to cause the trolleys (464, 466) to move back and forth from the produce loading station 404 to the produce compression station 426. Each of the trolley assemblies (464, 466) comprise one or more segments of a split chute (either 486 or 488), a split chute bracket 494, a split chute elevation actuator 498, a split chute separation actuator 496, a plurality of inboard trolley wheels 476, and optionally at least two outboard trolley wheels 478. In the example of FIG. 9, each trolley assembly includes six inboard trolley wheels 476. The inboard trolley wheels 476 ride on a trolley rail 462 attached to a trolley rail support beam 460. The optional outboard trolley wheels ride on another trolley rail (not illustrated) attached to the tray loading station 400 support frame 402. In alternative embodiments of a produce tray filler 100, different numbers and arrangements of trolley wheels and trolley rails may be used.

Figure 10:
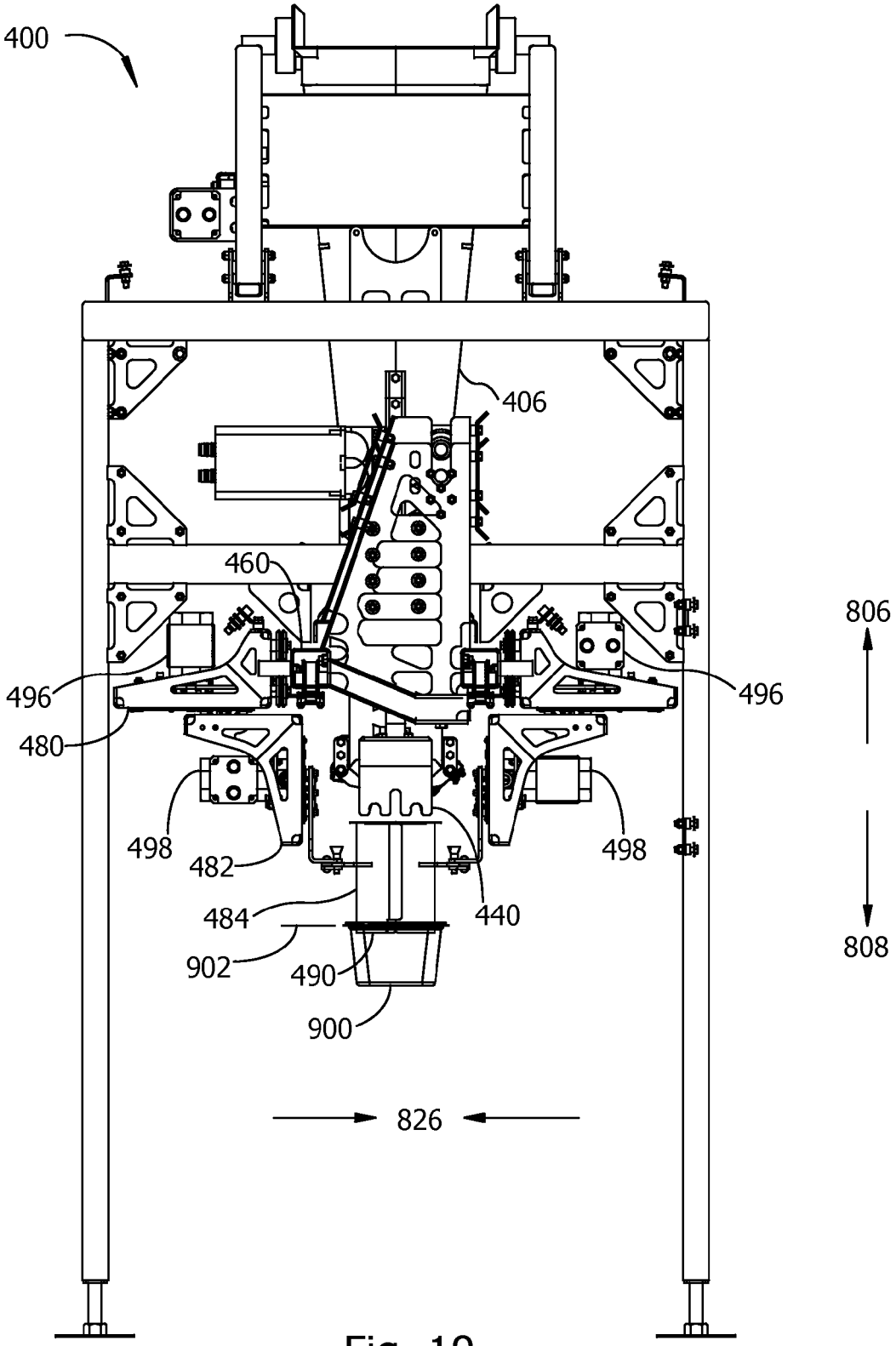
FIG. 10 is a partial orthographic view toward the output end of the tray loading station of FIGS. 8-9, showing a retracted plunger with a tuck-finger platen and left and right sides of a split transfer chute in contact with one another for transferring produce into produce trays.

Operation of the split chutes and plunger assemblies will be explained with reference to FIGS. 10-11. FIGS. 10-11 both show a partial orthogonal view toward the back side, also referred to as the output end, of the tray loading station 400. The conveyor, tray carriers, and some other components have been omitted from FIGS. 10-11 to simplify the illustrations. However, a reference line 902 has been marked in both figures to indicate a position of a top surface of a produce tray 900. The reference line 902 may be used to compare vertical positions of components in FIG. 10 and FIG. 11. FIG. 10 also includes inboard direction reference arrows 826, and FIG. 11 includes outboard direction reference arrows 828.

Continuing with FIG. 10, the split chute 484 is shown with its bottom edge 490 below the top surface 902 of the produce tray 900, thereby preventing produce spillage from the produce tray during processing in the tray loading station 400. In FIG. 10, the split chute 484 has been lowered into the produce tray by the split chute elevation actuator 498 on the lower trolley bracket 482. The lower trolley bracket 482 may selectively be driven laterally in an inboard direction or an outboard direction by the split chute separation actuator 496 attached to the upper trolley bracket 480. The tuck finger platen 440 is shown in its retracted position at the start or completion of a produce compression step.

FIG. 10 is representative of two different stages of produce tray processing. In a first processing stage, the produce trays 900 and split chutes 484 are aligned with the three stationary chutes (420, 422, 424 as seen in FIG. 8). Each of the produce trays is loaded in turn with produce dumped into the fill hopper 406. Then, the left and right side trolley assemblies (464, 466 as in FIG. 9) move the split chutes with their bottom ends still in the trays and the conveyor moves the produce trays to the produce compression station 426 until the split chutes 484 and produce trays 900 are aligned with the tuck finger platens 440.

After the produce trays 900 are aligned with the tuck finger platens 440, the conveyer halts and the platens are moved downward by the split chute elevation actuators 498, passing through the joined split chutes and compressing the produce in the produce trays. The split chutes reduce product spillage by remaining connected to one another during the early stages of produce compression. After the tuck finger platens 440 pass below the top edges of the produce trays and while the platens remain in contact with the produce in the trays, the split chute elevation actuators 498 may simultaneously lift the split chute left and right sides out of the produce trays. The separation actuators 496 then displace the lower trolley brackets 482 in an outboard 828 lateral direction, separating the split chute right sides 488 from the split chute left sides 486 as shown for the split chute visible in FIG. 11. The split chutes on the right side and left side trolley assemblies may optionally be returned to the produce loading station 404 to begin loading a new batch of produce trays while the previous batch of filled trays is still being compressed, enabling a reduction in time required for tray filling and tray compression and increasing a rate of tray throughput compared to systems which do not have split transfer chutes.

Figure 12:
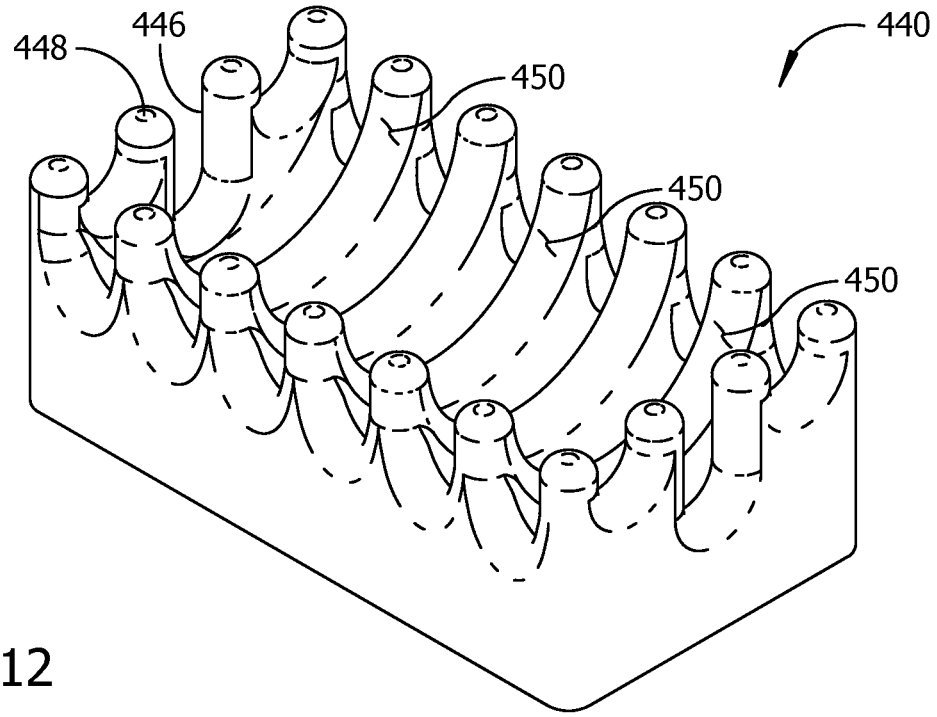
FIG. 12 is a partial pictorial view of an example of a tuck-finger platen, with the platen rotated from its orientation during use in a produce tray filler to show the compression side of the platen.

An example of a tuck finger platen 440 is shown in FIGS. 12-17. In FIGS. 12-17, the tuck finger platen 440 is shown with the tuck fingers 446 facing upward, opposite to the orientation of the platen while it is in use in a produce tray filler. FIG. 12 shows a pictorial view of the tuck finger platen 440 with a viewing direction toward the compression side of the platen. As may be seen in FIG. 12, the tuck finger platen 440 includes a plurality of tuck fingers 446 spaced at intervals around the periphery of the platen. Each tuck finger 446 is formed with a rounded end 448. Pairs of tuck fingers 446 on opposite sides of the platen are joined by rounded arcuate ridges 450. All surfaces and edges on the tuck finger side of the platen are smoothly rounded as shown in the figures. The channels formed between the arcuate ridges 450 prevent pieces of produce larger than the ridge-to-ridge separation distance, such as leaves from spinach or lettuce, from adhering to the compression face of the tuck finger platen.

The channels formed between the arcuate ridges 450 and the spaces separating adjacent tuck fingers 446 provide an outflow path for air removed from a mound of produce undergoing compression. The arrangement of tuck fingers around the perimeter of the platen causes the platen to compress the center of a mound of produce in a produce tray less than produce near the edges of the tray. Produce near the edges of the tray comes into contact with the tuck fingers, while produce near the center of the tray contacts the arcuate ridges, "tucking" the produce near the edges tightly to reduce re-expansion of the produce after the platen is removed from the tray. The rounded tuck fingers reduce bruising and crushing compared to stepped or flat platens and the arcuate ridges gently compress the produce near the center of the tray with little risk of damage to tray contents.

Figure 13:
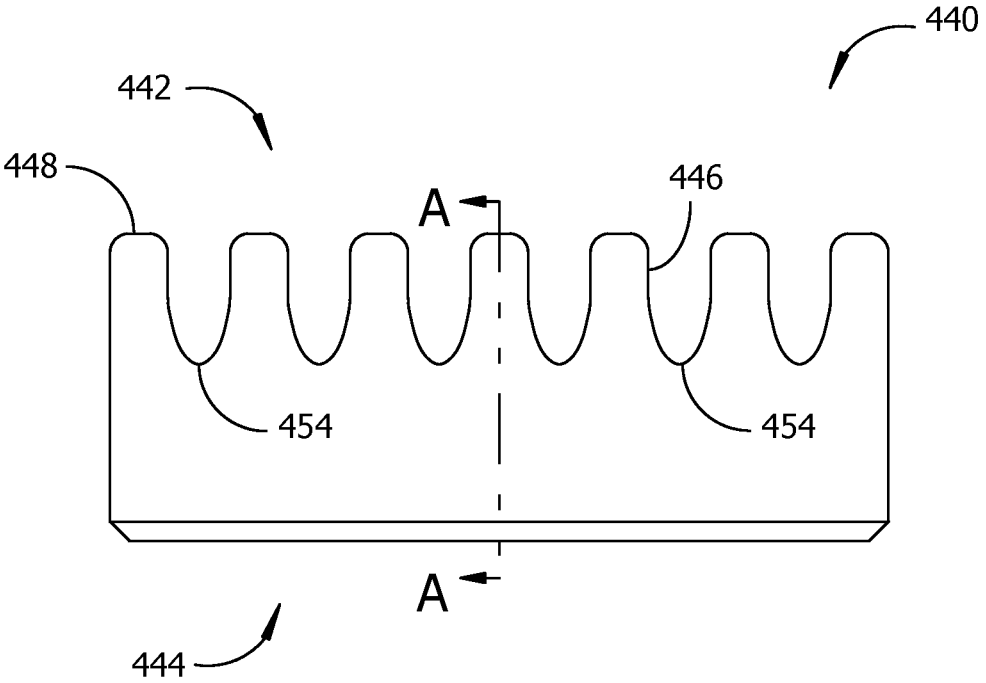
FIG. 13 is a side orthographic view of the tuck-finger platen of FIG. 12.
Figure 14:
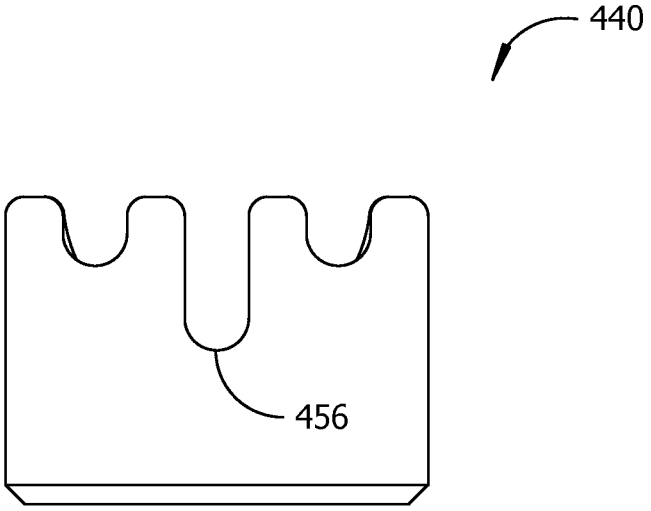
FIG. 14 is an end orthographic view of the tuck-finger platen of FIGS. 12-13.
Figure 15:
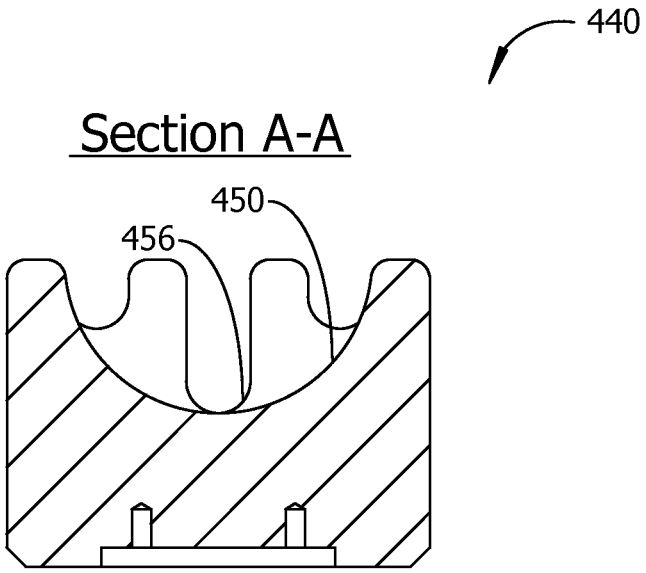
FIG. 15 is a cross-sectional view of the tuck-finger platen example of FIGS. 12-14, with a location and viewing direction for the cross section marked by section line A-A in FIG. 13.

Continuing with the figures, a side view of the example of a tuck finger platen from FIG. 12 is shown in FIG. 13. Side vents 454 formed between adjacent tuck fingers are visible in FIG. 13. FIG. 14 shows an end view of the tuck finger platen of FIGS. 12-13. As shown in FIG. 14, an end vent 456 may optionally be provided as an outlet for air released from the mound of produce into the channel next to the arcuate ridge during produce compression. The end vent 456 is shown again in cross section A-A in FIG. 15, which further illustrates that tuck fingers on opposite sides of the platen are connected by a smoothly rounded arcuate ridge 450.

Figure 16:
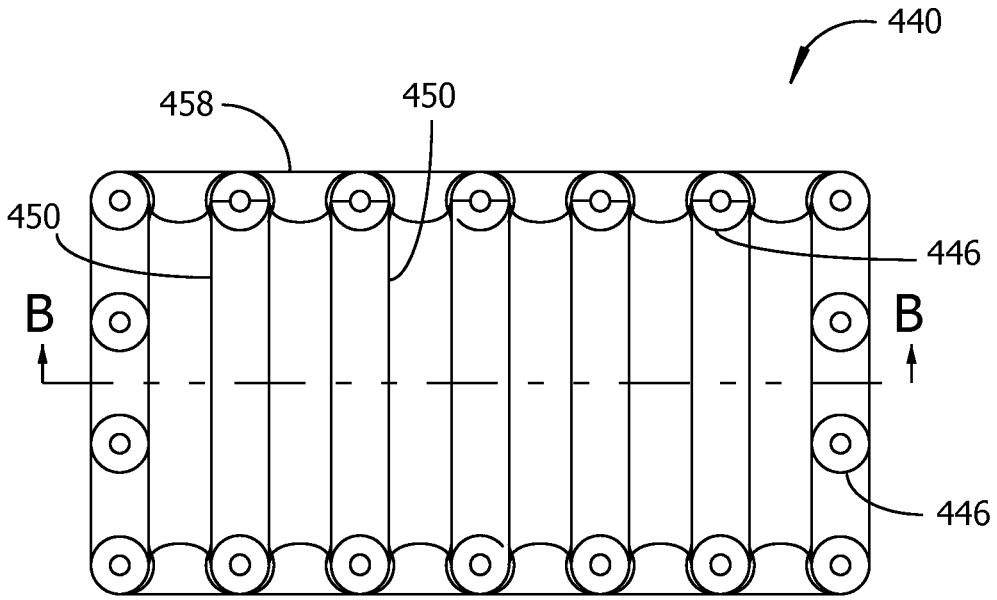
FIG. 16 is an orthographic view toward the compression side of the tuck-finger platen of FIGS. 12-15.

FIG. 16 shows another view of the arcuate ridges 450 and tuck fingers 446. FIG. 16 is an orthogonal view toward the compression face of the tuck finger platen 440 of FIGS. 12-15. FIG. 16 also shows that a tuck finger platen 440 is preferably formed with an outer perimeter shape 458 that corresponds to the perimeter shape of a produce tray that will be processed with the platen. In the example of FIG. 16, the platen 440 has a rectangular perimeter for use with rectangular produce trays. The tuck finger platen 440 may alternatively be formed with other perimeter shapes selected to match other shapes of produce trays.

Figure 17:
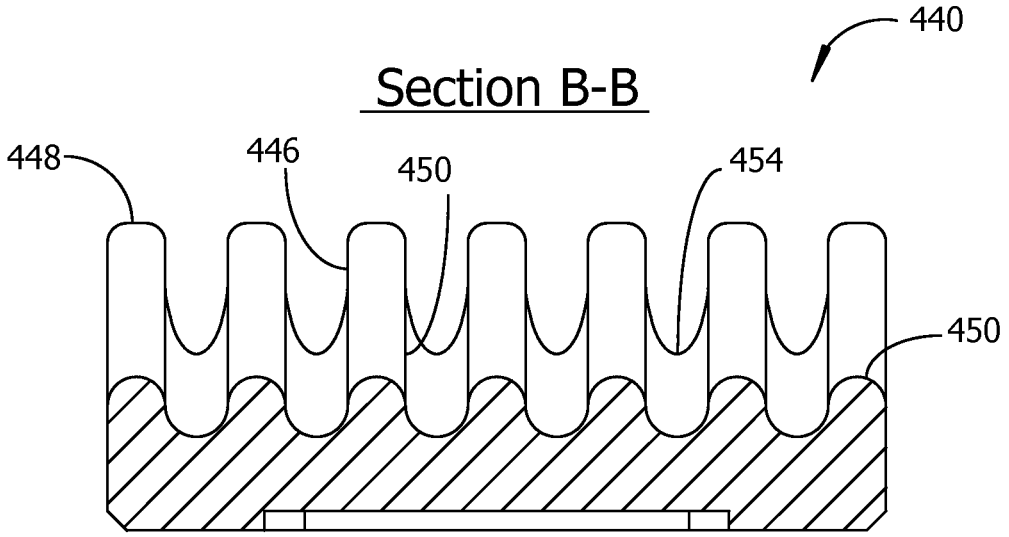
FIG. 17 is a cross-sectional view of the tuck-finger platen example of FIGS. 12-16, with a location and viewing direction for the cross section marked by section line B-B in FIG. 16.

A longitudinal cross section B-B of the tuck finger platen of FIGS. 12-16 is shown in FIG. 17. As may be seen in FIG. 17, arcuate ridges 450 join smoothly to tuck fingers 446, thereby forming intervening side vents 454 through which air may escape. The diameter of the tuck fingers, the widths of the arcuate ridges, and the amount of curvature of the arcuate ridges may be chosen to cause a selected difference in compression pressure for produce near the center of a produce tray compared to produce near the interior side walls of the tray.

In the example of a tuck finger platen 440 shown in FIGS. 12-17, all of the tuck fingers 446 are approximately the same size and shape, that is, the ends 448 of all the tuck fingers 446 extend from the top surface 444 of the platen 440 by about the same distance. Furthermore, all of the tuck fingers 446 are shown as having approximately the same approximately cylindrical shape with rounded ends. In alternative embodiments of the invention, some tuck fingers 446 may be longer than others, tuck fingers may have shapes that are not cylindrical but could be elliptical, tapered, or other rounded extended shapes. Shapes of some tuck fingers may be different than the shapes of other tuck fingers on a same platen. Spacing between tuck fingers may be varied at different places on a same platen. And, although the illustrated examples show tuck fingers that are approximately perpendicular to the top side of the platen, an angle between one or more tuck fingers and the top side of the platen may be selected to be other than perpendicular. Angled tuck fingers may be advantageous, for example, for compressing produce in produce trays that have angled side walls. All of these variations in the number, size, shape, placement, and angle of tuck fingers on a tuck finger platen are considered to be within the scope of the disclosed embodiments.

Unless expressly stated otherwise herein, ordinary terms have their corresponding ordinary meanings within the respective contexts of their presentations, and ordinary terms of art have their corresponding regular meanings.

What is claimed is:

1. An apparatus for filling a produce tray with agricultural produce, comprising:

a tray loading station comprising a fill hopper for receiving the agricultural produce;

a produce compression station comprising a tuck finger platen, said tuck finger platen comprising:

a compression side;

a plurality of tuck fingers, each of said tuck fingers comprising an end extending downward from said compression side;

a plurality of ridges extending laterally across said compression side, each of said plurality of ridges comprising:

a first of said tuck fingers joined to said ridge with said first tuck finger adjacent a lateral outer edge of said tuck finger platen; and a second of said tuck fingers joined to said ridge with said second tuck finger adjacent an opposite lateral outer edge of said tuck finger platen, said end of said first tuck finger and said end of said second tuck finger extending downward beyond said plurality of ridges;

at least two additional of said tuck fingers adjacent a first end of said tuck finger platen; and at least two additional of said tuck fingers adjacent a second end of said tuck finger platen;

a conveyer comprising a plurality of quick-release tray carriers for moving the produce tray from said tray loading station to said produce compression station;

a split chute for transferring the agricultural produce from said fill hopper to the produce tray; and a first trolley for selectively positioning said split chute under said fill hopper or under said tuck finger platen.

2. The apparatus of claim 1, wherein said each of said plurality of quick-release tray carriers further comprises:

a removable tray insert formed with a central aperture having a perimeter shape corresponding to the perimeter shape of the produce tray;

a pair of opposing tray insert brackets located on opposite sides of a central aperture formed in said quick-release tray carrier and positioned for a close sliding fit of said tray insert;

a tray insert stop for positioning said tray insert relative to said tray carrier; and a quick-release lever for removably connecting said tray insert to said tray carrier.

3. The apparatus of claim 1, further comprising:

a front stationary chute;

a middle stationary chute; and a back stationary chute, wherein said fill hopper is selectively rotated to a selected one of said front, middle, or back stationary chutes for loading agricultural produce into a selected produce tray in said produce loading station.

4. The apparatus of claim 1, wherein said tuck finger platen is adapted to compress agricultural produce near the center of the produce tray less than agricultural produce near the interior side walls of the produce tray.

5. The apparatus of claim 1, wherein said plurality of tuck fingers are spaced around a perimeter of said tuck finger platen at approximately equal intervals.

6. The apparatus of claim 1, where each of said plurality of ridges is formed between said first and second tuck fingers with an arcuate shape curved in a transverse arch across said touch finger platen, wherein.

7. The apparatus of claim 1, wherein channels formed between adjacent ridges extend to opposite lateral sides of said tuck finger platen, thereby providing a path for air to escape from a mound of agricultural produce being compressed in a produce tray by said tuck finger platen.

8. The apparatus of claim 1, wherein at least one of said plurality of tuck fingers is formed with a cylindrical shape extending outward from said plurality of ridges.

9. The apparatus of claim 1, wherein at least one of said plurality of tuck fingers is formed with a rounded end.

10. An apparatus for filling a produce tray with agricultural produce, comprising:

a tray loading station comprising a fill hopper for receiving the agricultural produce;

a produce compression station comprising a tuck finger platen;

a conveyer comprising a plurality of quick-release tray carriers for moving the produce tray from said tray loading station to said produce compression station;

a first trolley for selectively positioning a split chute under said fill hopper or under said tuck finger platen;

a split chute for transferring the agricultural produce from said fill hopper to the produce tray, said split chute comprising:

a split chute right side movably coupled to said first trolley; and a split chute left side separable from said split chute right side; and a second trolley movably coupled to said split chute left side, wherein said split chute left side and said split chute right side are connected together when the produce is loaded into the tray and said split chute left side and said split chute right side are separated from one another when said first trolley and said second trolley move from said produce compression station to said produce loading station.

11. The apparatus of claim 10, wherein said first trolley further comprises:

a first split chute bracket attached to said split chute right side;

said split chute right side further comprising a bottom edge; and a first split chute elevation actuator for lowering said bottom edge of said split chute right side into the produce tray, thereby preventing the agricultural produce from spilling from the tray when the agricultural produce is loaded into the tray and when the agricultural produce is compressed by said tuck finger platen.

12. The apparatus of claim 10, wherein said first trolley further comprises a first split chute separation actuator for laterally separating said split chute right side from said split chute left side, and said split chute right side is separated from said split chute right side before said first trolley moves from said produce compression station to said produce loading station.

13. The apparatus of claim 10, further comprising:

a plurality of said split chute right side attached to said first split chute bracket; and said produce compression station further comprising a plurality of said tuck finger platen equal in number to a number of said plurality of split chute right side, thereby enabling the agricultural produce in more than one produce tray to be compressed simultaneously.

14. The apparatus of claim 10, wherein said second trolley further comprises:

a second split chute elevation actuator;

a second split chute separation actuator;

a second split chute bracket attached to said split chute left side and movably coupled to said second split chute elevation actuator and said second split chute separation activator; and a plurality of said split chute left side attached to said second split chute bracket.

15. The apparatus of claim 14, wherein said first and second split chute actuators operate synchronously with each other, said first and second split chute elevation actuators operate synchronously with each other, and said first and second trolleys move synchronously with each other.

* * * * *